United States Patent [19]

Vieau

[11] Patent Number: 4,862,647

[45] Date of Patent: Sep. 5, 1989

[54] RAIL GRINDING MACHINE

[75] Inventor: Robert G. Vieau, Plymouth, Minn.

[73] Assignee: Loram Maintenance of Way, Inc., Hamel, Minn.

[21] Appl. No.: 91,231

[22] Filed: Aug. 31, 1987

[51] Int. Cl.[4] ..... E01B 31/17

[52] U.S. Cl. ..... 51/178

[58] Field of Search ..... 51/178, 241 LG, 241 R

[56] References Cited

U.S. PATENT DOCUMENTS

| | | |
|---|---|---|
| 3,358,406 | 12/1967 | Speno, Jr. et al. . |
| 3,423,858 | 1/1969 | Speno . |
| 3,526,997 | 9/1970 | Panetti . |
| 3,606,705 | 9/1971 | Rivoire . |
| 3,707,808 | 1/1973 | Danko et al. . |
| 3,888,052 | 6/1975 | Panetti . |
| 4,115,857 | 9/1978 | Panetti . |
| 4,189,873 | 2/1980 | Panetti . |
| 4,492,059 | 1/1985 | Panetti . |
| 4,583,327 | 4/1986 | Jaeggi . |
| 4,583,895 | 4/1986 | Theurer . |
| 4,584,798 | 4/1986 | Rivoire . |
| 4,596,092 | 2/1986 | Panetti . |
| 4,615,150 | 10/1986 | Panetti . |
| 4,622,781 | 11/1986 | Vieau et al. . |

OTHER PUBLICATIONS

Article Entitled "Computerized Switch Grinder", p. 50 from *Progressive Railroading*, Jul. 1986.

Photographs of Grinding Machine Manufactured by Jackson Jordan Taken May 1987.

Brochure Entitled "Fairmont Series RGH-8 Precision Maintenace Grinder".

*Primary Examiner*—Roscoe V. Parker

*Attorney, Agent, or Firm*—Dorsey & Whitney

[57] ABSTRACT

A railroad mounted grinding machine for maintaining the railhead profile of railroad track rails. A plurality of grinding modules are mounted on an undercarriage. The undercarriage is shiftably carried, by a track engaging platform, for side to side positioning of the grinding module across the longitudinal axis of a rail. Each grinding module is independently tiltable relative to the undercarriage.

19 Claims, 7 Drawing Sheets

Fig. 4
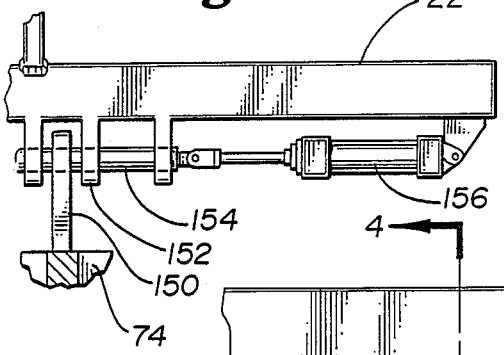
Fig. 3
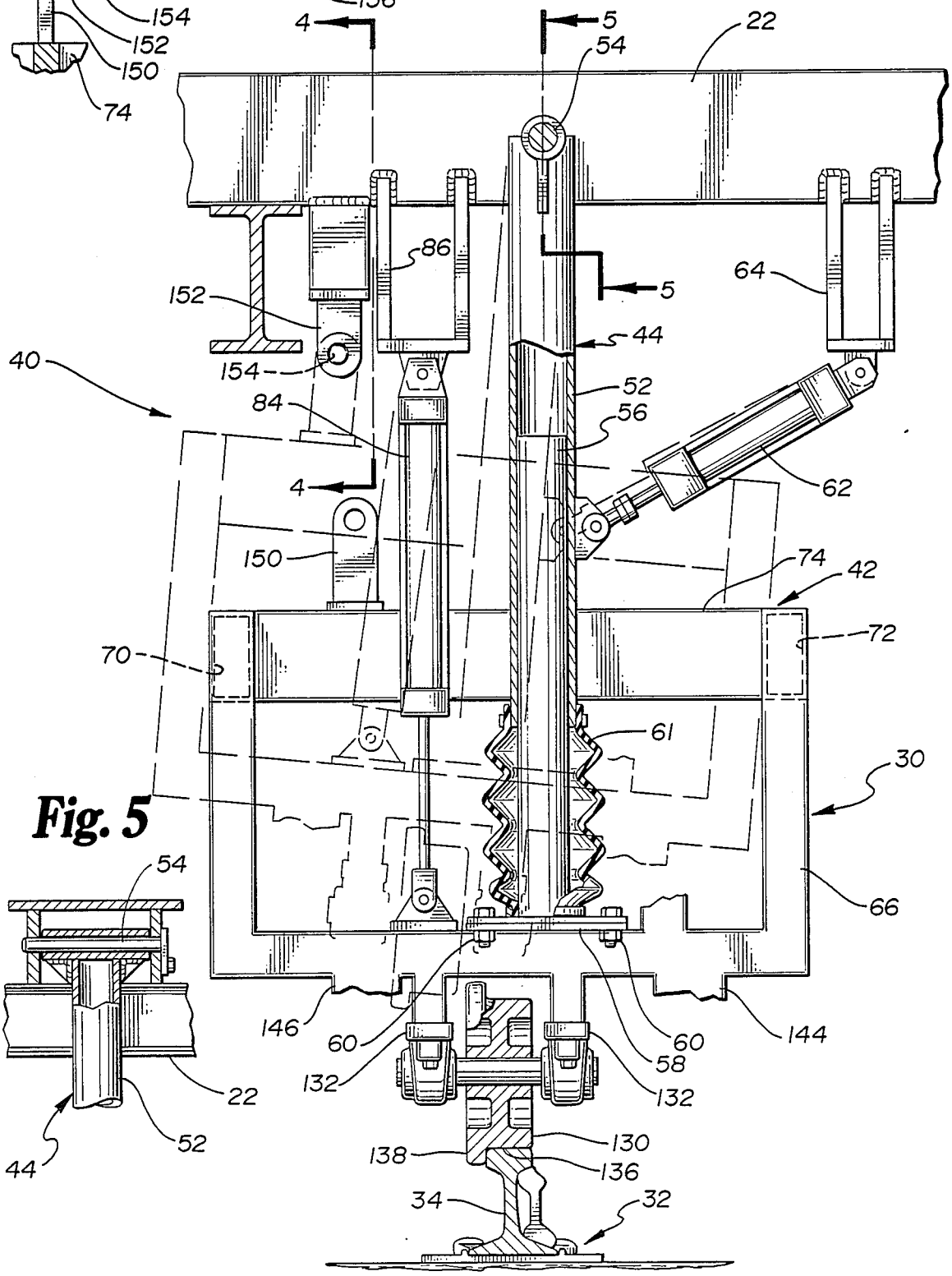
Fig. 5

RAIL GRINDING MACHINE

TECHNICAL FIELD

This invention relates to rail grinding machines adapted to travel along railroad tracks and perform grinding operations on track rail surfaces. In particular, it pertains to a unique undercarriage for supporting grinding units on such rail grinding machines.

BACKGROUND ART

Railroad track rails are subject to wear by the passage of trains over the rails. In particular, depressions in the upper surface of a rail may develop such that the rail head presents an undulating, corrugated surface. Moreover, the rail may develop burrs, or otherwise lose its symmetrical profile. Maintenance of smooth running surfaces on railroad track rails is important for reasons of safety, riding comfort, protection of the track, track bed and rolling stock, noise suppression, and reduced maintenance of the track and track bed.

Grinding machines for maintaining railroad track rails in smooth, properly shaped condition are known. Such grinding machines generally comprises a plurality of rotatable grinding modules carried by a locomotive or the like in close proximity to the rail head surfaces of a railroad track. The grinding modules include rotatable, abrasive grinding stones that can be lowered into a position flush with the rail surface to grind and restore the rail surface to a smooth, desired profile.

The grinding modules of such grinding machines includes replaceable, abrasive grinding stones that are rotated about a grinding axis. The condition of the grinding stones directly affects the quality of grinding. More particularly, the grinding stones preferably present a generally flat, annular grinding surface, that is perpendicular to the axis of rotation of the grinding stones. While the grinding surface of a grinding stone is of course altered and worn in the grinding process, the grinding surface can be maintained essentially flat and perpendicular to the grinding axis by grinding only on the inner diameter of the stone. That is to say, placement of the annular grinding surface on the rail should be such that the rail sides do not extend beyond the inner diameter of the grinding stone. Moreover, it has long been considered preferable to have the grinding marks left by the grinding stone on the railhead be perpendicular to the rail longitudinal axis. Such perpendicular grinding marks are left when the grinding is done on the inner diameter of the stone. More precisely, perpendicular grinding marks are left on the railhead when the line of contact between the grinding stone and the railhead is along a diameteral line of the grinding stone, perpendicular to and intersecting the grinding axis of rotation.

Grinding modules, with their attached grinding stones, can be tilted to accommodate grinding of railheads in planes other than the horizontal. Tilting of the grinding stone about a tilt axis oriented above and along the rail, however, shifts the line of contact of the grinding stone with the rail away from the diameteral line of the stone, and, depending on the angle, can shift the grinding contact away from the inner diameter of the stone. In short, tilting of the grinding stone, although necessary in order to shape the profile of a rail, can cause uneven wear of the stone and can leave grinding marks transverse to the perpendicular of the rail longitudinal axis.

Another consideration when grinding rails to a desired profile is the presence of obstructions to the grinding stone. At road crossings, where the track intersects a highway for instance, wooden ties or rubber guards are typically brought into close proximity of the track rails to allow for smooth passage of wheeled vehicles across the track rails. Tilting of the grinding modules and grinding stones to shape the profile of the railhead can bring the grinding stones into interfering contact with the wooden ties or rubber guards.

Finally, the grinding modules of rail grinding machines are typically raised into storage positions on the supporting locomotive or the like when not being operated to grind rails. The modules must therefore be lowered and propery oriented along the rail head prior to conducting grinding operations. The rail contacting support mechanisms for initially positioning and orienting the grinding modules are typically larger and more expensive than the size of wheels or other rail contacting support mechanisms required to maintain the modules in proper orientation once in place. In the past, the functions of orienting the grinding modules and supporting the grinding modules once in place have been combined into a single support device. While only a small area of the support device is subjected to continuous contact with the railhead, the entire device must be discarded when the device becomes worn.

SUMMARY OF THE INVENTION

The rail grinding machine in accordance with the present invention includes a plurality of grinding modules individually, pivotally mounted on an undercarriage that is in turn shiftable from side to side relative to a supporting locomotive or the like for lateral positioning of the grinding module across the longitudinal axis of a rail. Under normal grinding conditions, the ability to shift grinding modules from side to side across the railhead enables the grinding stones to be placed in grinding contract with the railhead along a diameteral line of the grinding stone, regardless of the tilt angle of the grinding module. When grinding through crossings or other obstructions, the lateral shifting capability of the undercarriage allows for grinding of the railhead at a larger range of tilt angles while still avoiding obstructions in close proximity to the rail.

The grinding module supporting undercarriage of the rail grinding machine in accordance with the present invention includes retractable guide roller assemblies that allow for accurate positioning of the rail grinding modules into grinding contact with a rail. The guide rollers are retractable during grinding operations, leaving support of the undercarriage to standard sized, rail engaging wheels.

BRIEF DESCRIPTION OF THE DRAWINGS

FIG. 3 is a fragmentary, front elevational view of one of the undercarriages of the rail grinding machine in accordance with the present invention, with parts removed for clarity, phantom lines depicting the undercarriage in the raised and locked position;

FIG. 4 is a fragmentary, sectional view taken along line 4—4 of FIG. 3;

FIG. 5 is a fragmentary, sectional view taken along line 5—5 of FIG. 3;

DETAILED DESCRIPTION OF THE DRAWINGS

Figure 2:
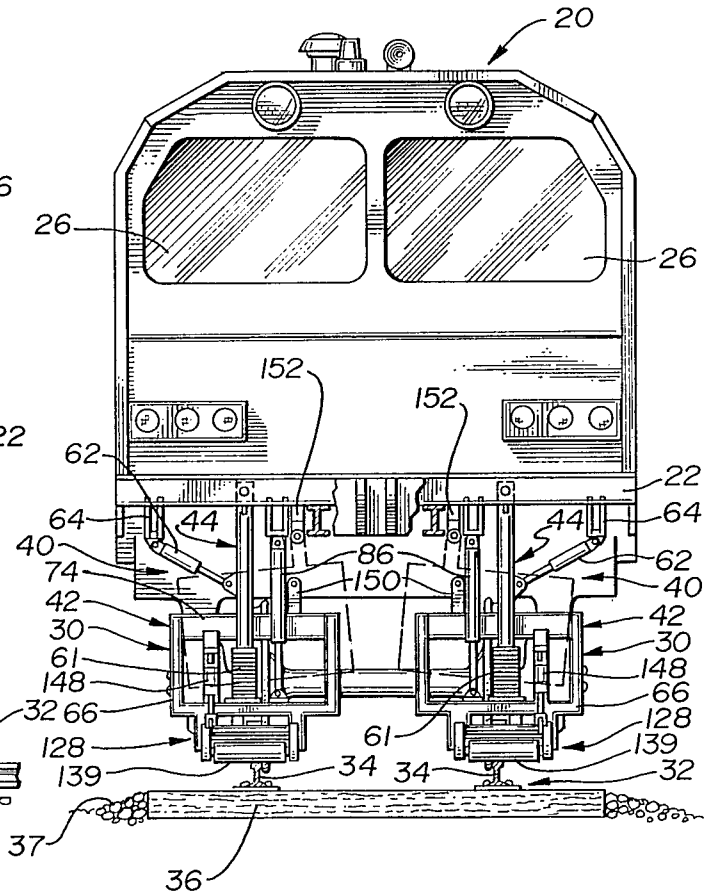
FIG. 2 is a front elevational view of a rail grinding machine in accordance with the present invention with parts removed for clarity, phantom lines depicting the grinding machine undercarriages in locked and raised positions.

A rail grinding machine 20 in accordance with the present invention broadly includes a main frame 22 supported by rail engaging wheels 24, operator cab 26, equipment compartment 28, and a plurality of grinding assemblies 30. The rail engaging wheels 24 support the rail grinding machine 20 on railroad track 32. The track 32 comprises a pair of rails 34 stretching across ties 36 of railroad bed 37.

Each grinding assembly 30 broadly includes a plurality fo grinding modules 38 individually mounted on a grinding assembly undercarriage 40. Each grinding assembly undercarriage 40 includes a grinding module support frame 42 attached to the rail grinding machine main frame 22 by fore and aft telescoping struts 44, 46. Each grinding module 38 is suspended from support frame 42 by fore and aft brackets 48 and 50.

Figure 1:
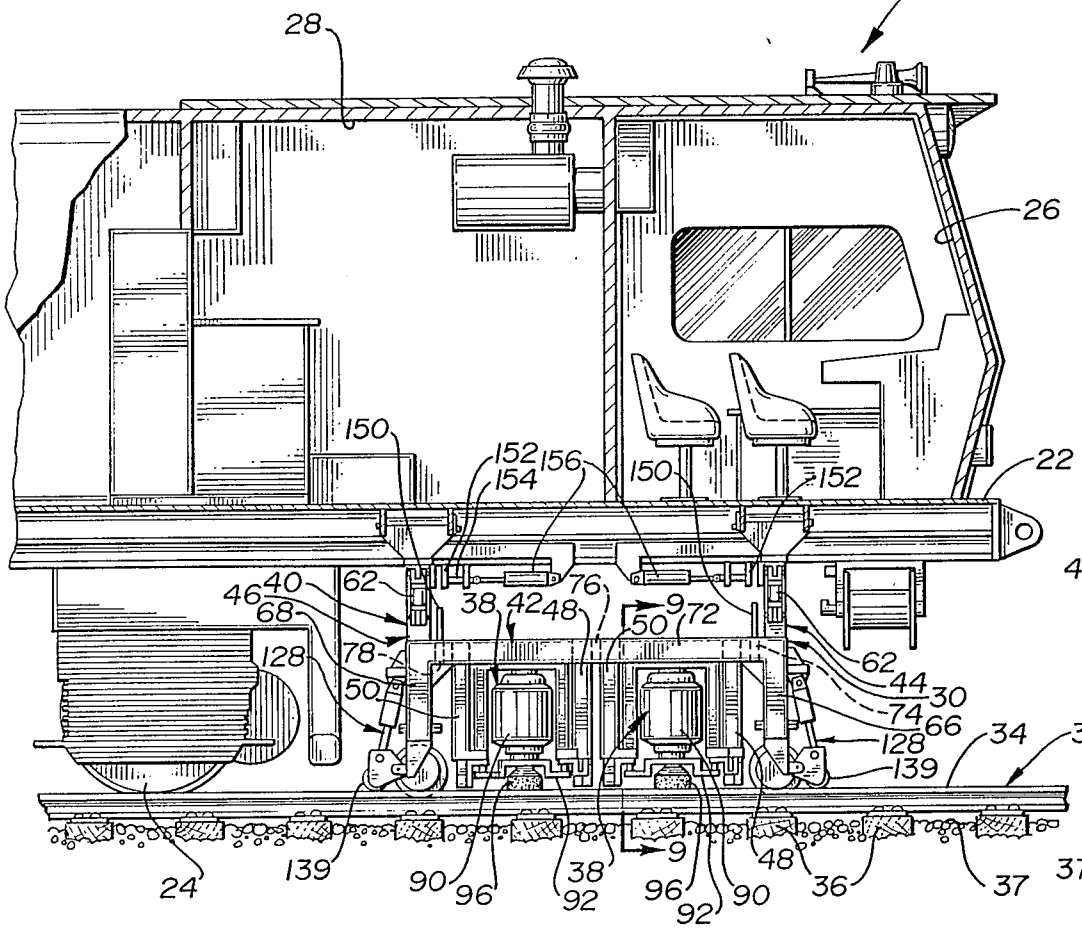
FIG. 1 is a fragmentary, side elevational view of a rail grinding machine in accordance with the present invention with the parts removed for clarity.
Figure 6:
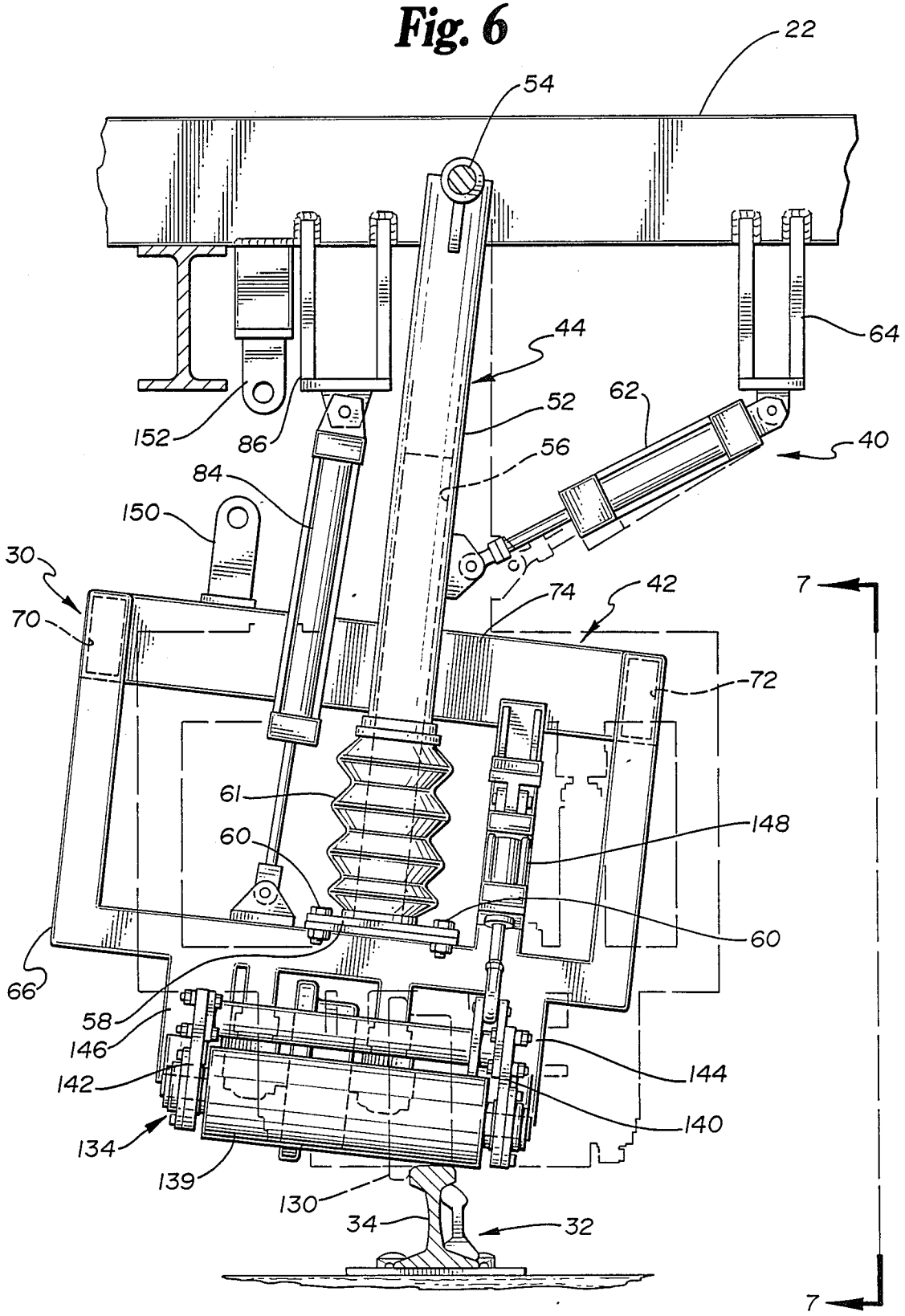
FIG. 6 is similar to FIG. 3 but with the undercarriage partially disengaged with the rail and guide roller assembly included, phantom lines depicting the undercarriage in the rail engaging position.
Figure 8:
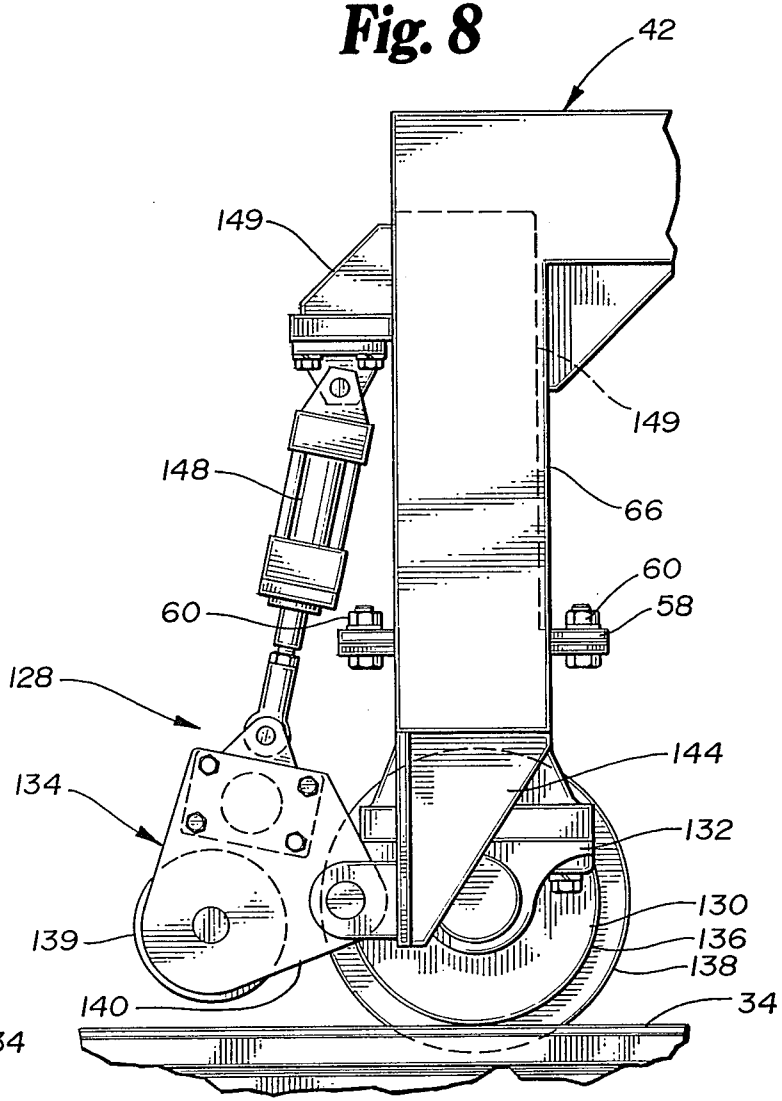
FIG. 8 is similar to FIG. 7, but with the guide roller in the raised position.
Figure 7:
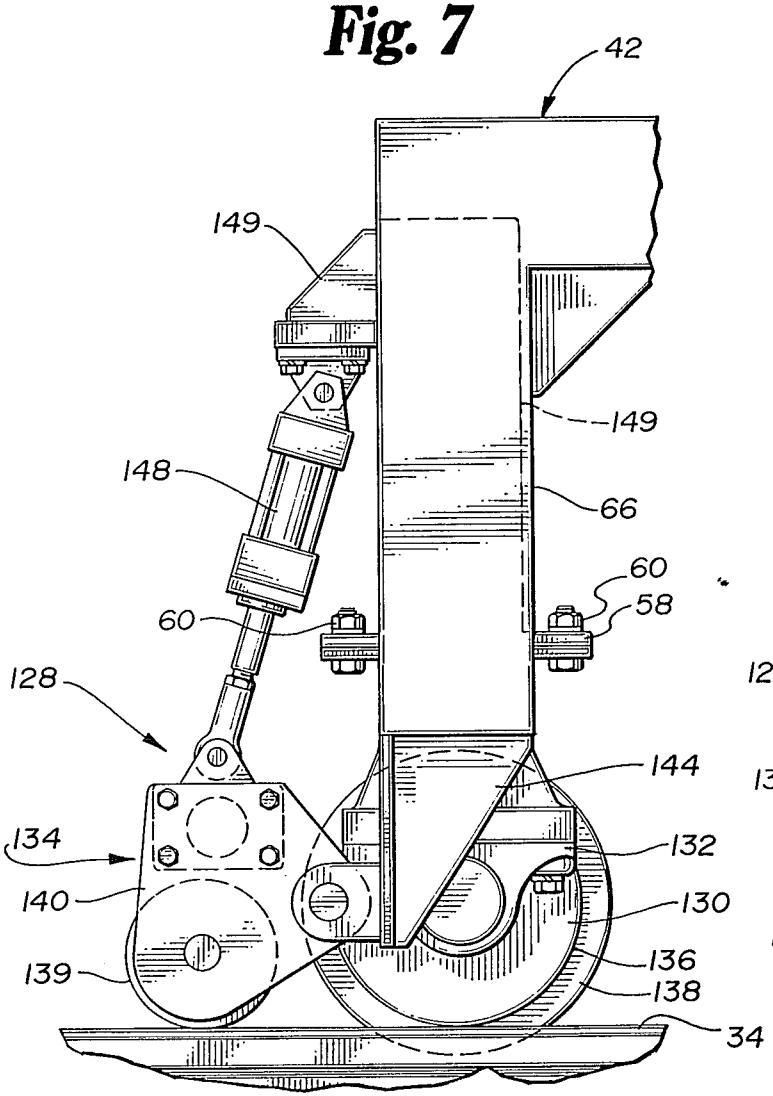
FIG. 7 is a fragmentary, side elevational view taken from the perspective of the line 7—7 of FIG. 6.

Referring in particular to FIGS. 1, 3 and 6, fore and aft struts 44, 46 each include outer slide tube 52 pivotally coupled to main frame 22 by pivot pin 54, and an inner slide rod 56 slidably received within outer slide tube 52. The inner slide rod 56 includes lowermost base plate 58 attached to support frame 42 by bolts 60. Extensible boot 61 extends between outer slide tube 52 and the base plate 58 of inner slide rod 56. Spreader piston and cylinder assemblies 62 extend between brackets 64 depending from the main frame 22 and the outer slide tube 52 of each fore and aft strut 44, 46.

Each grinding module support frame 42 includes fore and aft U-shaped support members 66, 68 interconnected by uppermost, gauge side and field side frame members 70, 72. Side to side braces 74, 76, 78 extend between the gauge side and the field side frames members 70, 72. A pair of fore and aft, horizontal slide rods 80, 82 extend between gauge side and field side frame members 70, 72 for slidable support of each grinding module 38. Fore and aft undercarrige elevation piston and cylinder assemblies 84 extend between brackets 86 depending from main frame 22 and the fore and aft U-shaped frame members 66, 68.

Each grinding module 38 includes grinding motor 90 supported on grinding module base plate 92, grinding shaft 94, and grinding stone 96. The grinding shaft 94 defines a center grinding axis 97 for each grinding module. Grinding stones 96 are annular grinding wheels each having lowermost grinding surface 98, inner stone diameter 100, and outer stone diameter 102. Shiftable, fore and aft, grinding module support rods 104, 106 extend upwardly from base plate 92 of each grinding module 38. A grinding module top brace 108 extends between each fore and aft, vertical, grinding module support rod 104, 106. The vertical, grinding module support rods 104, 106 are received within fore and aft, vertical, grinding module support sleeves 110, 112. Gauge side shroud 114 extends between sleeves 110, 112. The fore and aft grinding module support sleeves 110, 112 are pivotally connected to respective fore and aft brackets 48, 50 by pivot supports 116, 118. A grinding module elevation piston and cylinder assembly 120 extends between the forward pivot support 116 and top brace 108 of each grinding module 38.

Figure 9:
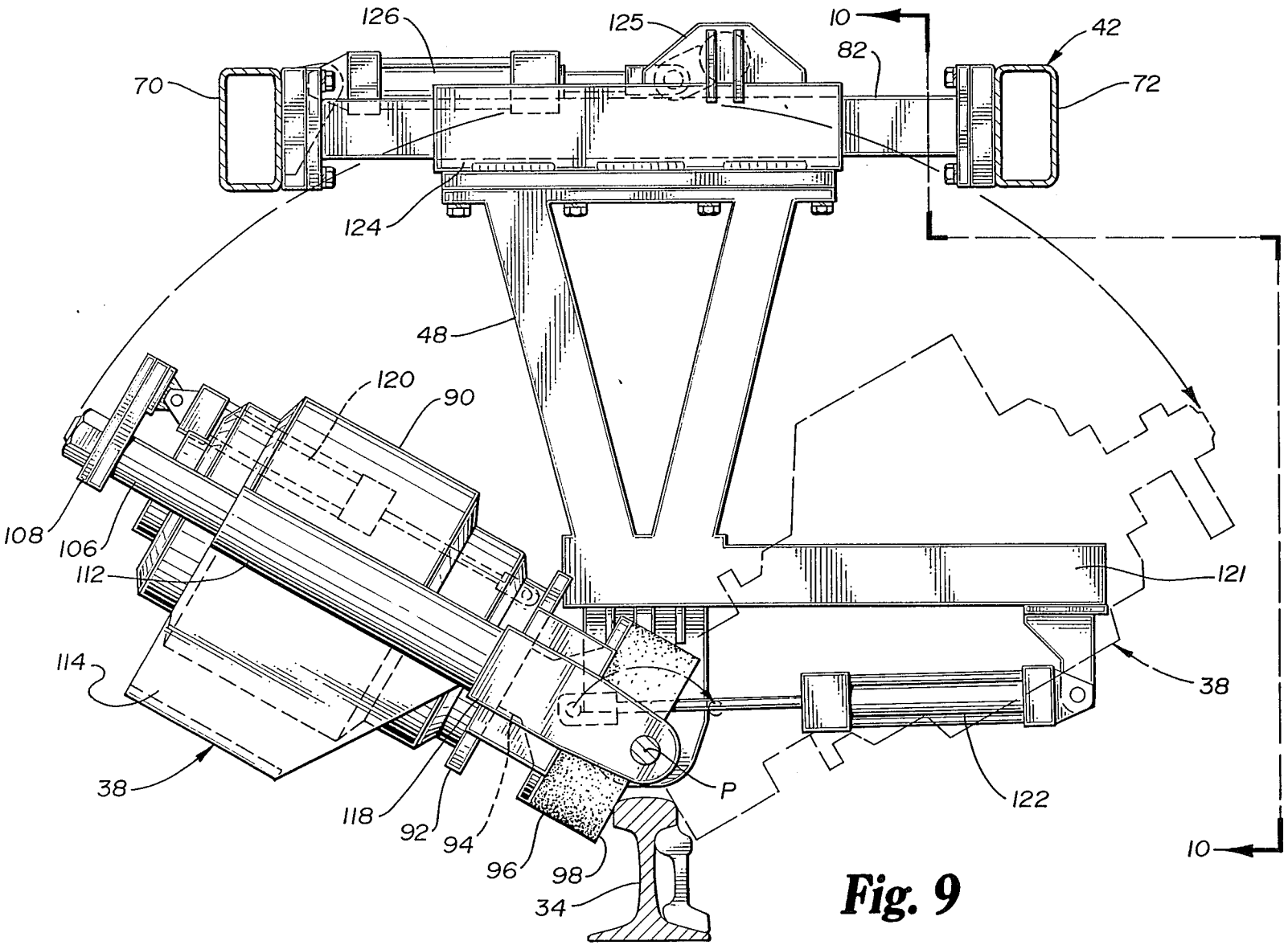
FIG. 9 is a sectional view taken along the line 9—9 of FIG. 1 with a grinding module shown in tilted configuration, phantom lines depicting the grinding module in an alternative tilted position.

Referring to FIG. 9, each grinding module forward bracket 48 includes a tilt cylinder supporting brace 121. A grinding module tilting piston and cylinder assembly 122 extends between the brace 121 and the forward pivot support 116 of each respective grinding module.

Figure 10:
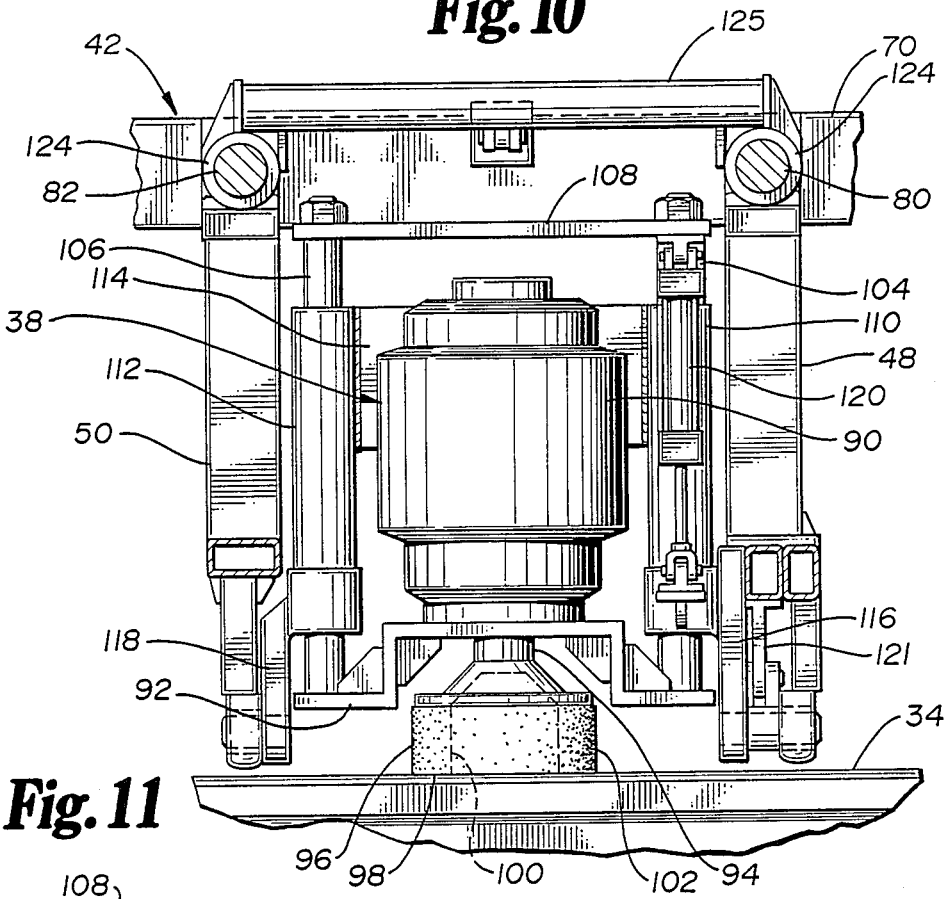
FIG. 10 is a sectional view taken along the line 10—10 of FIG. 9.
Figure 11:
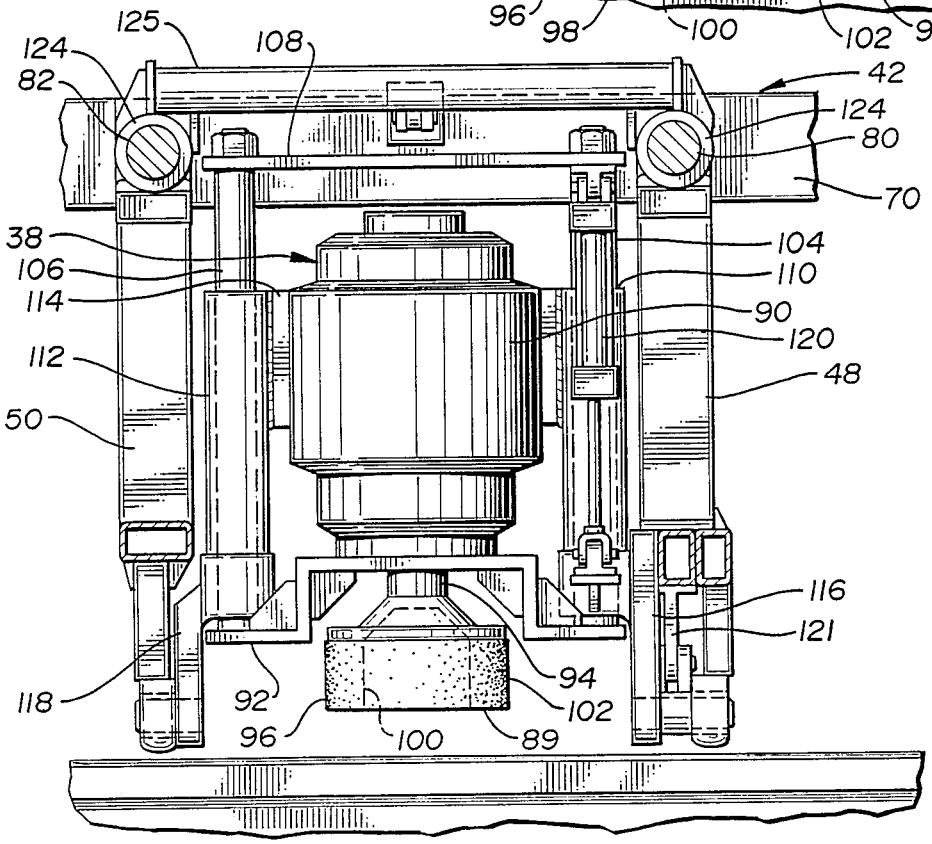
FIG. 11 is similar to FIG. 10, but with the grinding module in the raised position.

Again referring to FIG. 9, each of the fore and aft brackets 48, 50 are attached to a slide tube 124 carried by a respective fore or aft horizontal support rod 80, 82. As best seen in FIGS. 10 and 11, a horizontal brace 125 extends between the slide tubes 124 of each pair of grinding module fore and aft support brackets 48, 50. A grinding module horizontal positioning piston and cylinder assembly 126 extends between each horizontal brace 125 and gauge side frame member 70.

Grinding assembly supporting rail engaging wheel assemblies 128 are carried by each fore and aft U-shaped frame member 66, 68. Each wheel assembly 128 includes rail engaging wheel 130 rotatably attached to a respective U-shaped frame member 66, 68 by pillow blocks 132, and guide roller assembly 134. Wheels 130 include rail top engaging surface 136 and side rail engaging flange 138. The rail top engaging surface 136 of each wheel 130 is of a standard width, comparable to the width of the rail head.

Each guide roller assembly 134 includes a set down roller 139 rotatably supported by opposed gauge side and field side bearing plates 140, 142. The bearing plates 140, 142, are pivotally mounted to support brackets 144, 146 that extend downwardly from each U-shaped frame member 66, 68. A guide roller assembly piston and cylinder assembly 148 extends between the field side bearing plate 142 of each guide roller assembly 134 and a respective stanchion 149 carried by each fore and aft U-shaped frame member 66, 68.

Referring to FIG. 4, an upright securing flange 150 extends upwardly from each brace 74, 78. Securing flange receiving clevises 152 extend downwardly from main frame 42. Locking pins 154 are attached to locking pin actuating piston and cylinder assemblies 156 for shifting between securing flange engaging and securing flange clearing positions.

In operation, grinding assemblies 30 of rail grinding machine 20, when not in use, are transported in raised, noncontacting relationship with the rails 34 of track 32, as depicted by phantom lines in FIG. 2 and FIG. 3. In particular, securing flanges 150 of grinding assembly undercarriage support frame 42 are secured within flange receiving clevises 152 of main frame 22 by locking pins 154, and the fore and aft struts 44, 46 are fully retracted.

To commence guiding operations, locking pins 154 are shifted to their securing flange clearing position, as depicted in FIG. 1. The spreading piston and cylinder assemblies 62 are fully extended so as to tilt the individual grinding assemblies 30 inwardly towards the gauge side of rails 34. The grinding assemblies 30 are lowered towards railroad track 36 by extending the undercarriage elevation piston and cylinder assemblies 84.

Prior to lowering the grinding assemblies 30 towards the track 36, the guide roller assemblies 134 are pivoted downwardly by extending the guide roller piston and cylinder assemblies 148. Accordingly, the set down rollers 139 are the first members of the grinding assemblies 30 to come into contact with rails 34. Referring in particular to FIG. 6, it will be appreciated that the width of the guide rollers 139 ensures engagement of the guide rollers 139 with the rails 34, regardless of where the grinding assembly 30 is positioned by the spreader cylinders 62.

Contact of the guide rollers 139 with the rails 34 generally positions the grinding assemblies 30 in elevation. Once the guide rollers 139 have contacted the rail 34, the spreader piston and cylinder assemblies 62 can be retracted so as to shift the grinding assemblies 30 outwardly in a direction towards the field side of the rail 34. The rail engaging flange 138 of each wheel 130 will accordingly be brought into contact with the gauge side of rail 34. The guide roller piston and cylinder assemblies 148 can thereafter be retracted such that the weight of the grinding assembly 30 is borne by wheels 130. It will be understood, however, that an upward biasing force is exerted by the elevation piston and cylinder assemblies 86, 88 such that the entire weight of the grinding assembly 30 is not necessarily borne by the wheels 130. The spreader piston and cylinder assemblies 62 provides a constant biasing pressure to maintain the wheels 130 in engagement with rail 34.

Figure 12A:
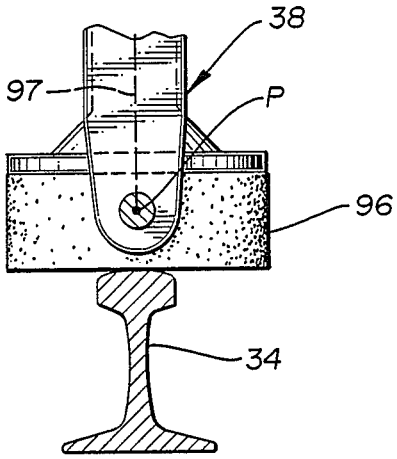
FIG. 12*a* is a schematic diagram of a grinding stone in grinding contact with the rail.
Figure 13:
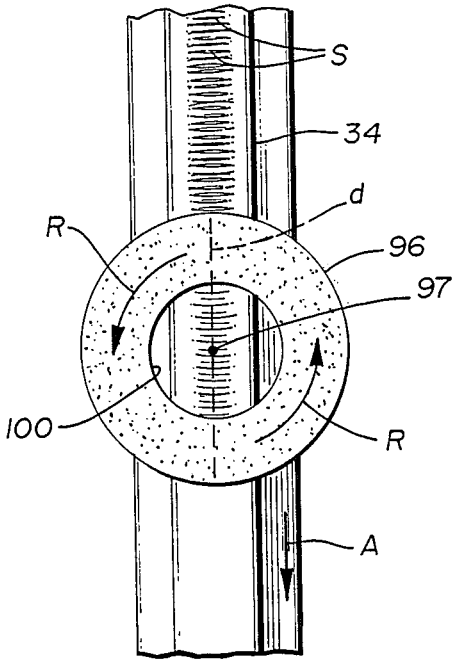
FIG. 13 is a schematic, plan view of a grinding stone in grinding contact with a rail.

The top surface of rail 34 is ground by placing the grinding stone 96 directly over the rail 34, as depicted in FIG. 12*a*. The grinding axis of rotation 95 is centered along the longitudinal axis of rail 34. Referring to FIG. 13, the rail 34 is contained between the inner diameter 100 of grinding stone 96, and grinding contact between the stone 96 and rail 34 is along a diameteral line d of the grinding stone 96. As the grinding stone 96 is rotated as indicated by arrows R of FIG. 13, and is moved along the rail 34 in the direction of arrow A of FIG. 13, the fine scratches S left on the rail 34 by the grinding action of the stone 96 are oriented perpendicular to the longitudinal axis of the rail 34.

Figure 12B:
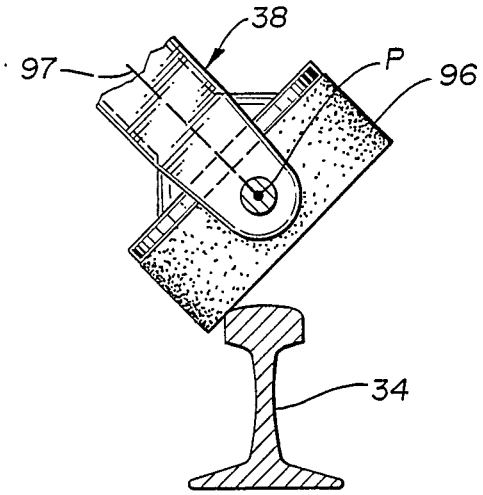
FIG. 12*b* is similar to 12*a*, but with the grinding stone tilted from the horizontal.

As depicted in FIG. 9, each grinding module 38 can be pivoted around pivot point P to position the grinding stone 96 at various tilt angles relative to the railhead. As shown in FIG. 12*b*, pivoting of the grinding module 38 around pivot point P, without shifting of the pivot point laterally in relation to the longitudinal axis of rail 34, shifts the line of grinding contact between the stone 96 and rail 34 from the center, diameteral line d of the grinding stone to a point outboard of the diameteral line d. While tilting of the grinding module 38 to the orientation depicted in FIG. 12*b* enables shaping of the railhead, the resultant shifting of the line of contact between the grinding stone 96 and the rail 34 away from the diameteral line d of stone 96 causes uneven wear of the stone 96. Moreover, orientation of the grinding stone 96 as depicted in FIG. 12*b* causes the scratches S left by the grinding operation to be transverse to the desired orientation perpendicular to the rail longitudinal axis.

Figure 12C:
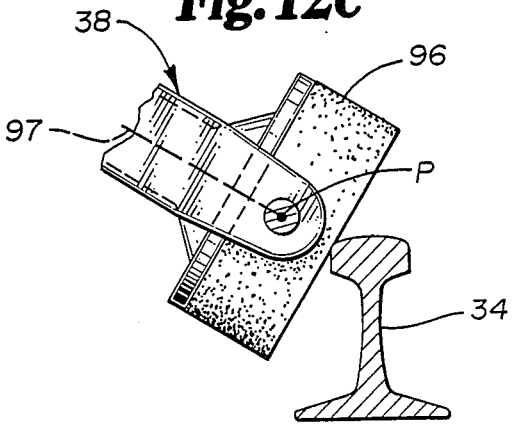
FIG. 12*c* is similar to FIG. 12*b*, but with the grinding stone shifted laterally.

The grinding module 38, together with pivot point P, can be shifted laterally relative to the longitudinal axis of rail 34 by the extension and retraction of piston and cylinder assembly 126. More particularly, extension of respective horizontal positioning piston and cylinder assemblies 126 shifts the associated undercarriage 40 towards the field side of rail 34, and retraction of the piston and cylinder assembly 126 shifts the undercarriage 40 towards the gauge side of rail 34. Moreover, elevation of each individual grinding module 38 relative to the undercarriage 40 can be adjusted by the extension and retraction of respective module elevation piston and cylinder assemblies 120. Accordingly, the pivot point P can be shifted away from the center of rail 34, as depcited in FIG. 12*c*, and the grinding stone 96 can be lowered into contact with the rail 34 along a diameteral line d of the grinding stone 96.

Figure 12D:
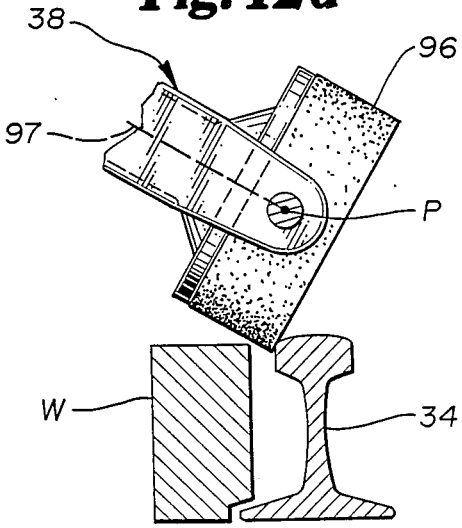
FIG. 12*d* is a schematic diagram of a grinding stone in tilted, grinding contact with a rail in the presence of an obstruction.

Referring to FIG. 12*d*, rail 34 is depicted in close proximity to an obstruction W. The obstruction could be a wooden support W placed along the rail at a highway crossing or the like. The presence of the obstruction W interferes with the placement of the grinding stone 96 relative to the rail 34. The capability to laterally shift the undercarriage 40 from side to side relative to the longitudinal axis of rail 34 provides a distinct advantage when grinding the rail 34 in the presence of an obstruction. In particular, referring to FIG. 12*d*, pivot point P can be shifted laterally away from the obstruction W thereby allowing the grinding stone 96 to be tilted to a greater tilt angle while still avoiding the obstruction, than would otherwise be attainable. Although the grinding contact with the stone 96 with the rail 34 is, in the instance depicted in FIG. 12*d*, moved away from the diameteral line d of the grinding stone 96, the amount of grinding required to be done in the presence of an obstruction is typically minimal.

I claim:

1. A rail grinding apparatus for grinding the rails of railroad track, comprising:

a main frame supported by said rails for movement along said railroad track;

an undercarriage operably carried by said main frame and shiftable between a raised rail clearing position and a lowered rail engaging position, said undercarriage including rail engaging wheels for supporting said undercarriage in said rail engaging position;

sensing means operably carried by said undercarriage for detecting the position of said rails as said undercarriage is lowered from said rail clearing position to said rail engaging position; and;

undercarriage wheel positioning means operably coupled to said sensing means for positioning said undercarriage wheels in abutting relationship with said rails when said sensing means detects the position of said wheels.

2. An apparatus as claimed in claim 1, said undercarriage wheel positioning means comprising means for shifting said undercarriage wheels transversely of said rail axis.

3. An apparatus as claimed in claim 2, including means for retracting said sensing means retractable from said rail when said undercarriage wheels engage such rails.

4. An apparatus as claimed in claim 3 said sensing means including a roller for engaging said rails in an abutting relationship, said roller being generally wider than said rails whereby said roller may engage said rail over a range of lateral roller positions.

5. An apparatus as claimed in claim 4, said sensing means including a roller bracket pivotably coupled to said undercarriage, said roller being rotably mounted in said roller bracket.

6. A rail grinding apparatus for grinding the rails of a railroad track, said rails each having a longitudinal rail axis, comprising:

a support frame supported by said rails for movement along said railroad track;

a plurality of grinding modules, each grinding module having a grinding head including a grinding stone engagable with one of said rails for grinding the rail;

vertical positioning means operably coupling one of said grinding modules to said support frame for selectively raising and lowering said one grinding module relative to said one of said rails independently of the vertical position of the other of said grinding modules;

horizontal positioning means operably coupling said one grinding module to said support frame for laterally shifting said one grinding module generally transversely to said longitudinal rail axis independently of the vertical orientation of said one grinding module and of the lateral position of the other of said grinding modules; and pivot means for operably coupling said one grinding module to said support frame about a pivot, whereby the grinding head of said one grinding module is selectively pivotable and is vertically and horizontally positionable independently of the vertical and horizontal orientation of said one grinding module and of the vertical, horizontal, or pivotal orientation of the other of said grinding modules, said undercarriage comprising a grinding module support frame generally centered about said one rail including fore and aft generally upright support members, and spaced apart field side and gauge side frame members extending between said support members, said undercarriage further including slide rods extending between said field side frame member and said gauge side frame member for supporting said grinding modules.

7. An apparatus as claimed in claim 6, each of said grinding modules being suspended from a respective pair of slide rods by fore and aft brackets, said brackets being shiftably carried by said slide rods.

8. An apparatus as claimed in claim 7, said horizontal shifting means including brace means operably coupling respective ones of said fore and aft brackets, and means for shifting said brace means relative to said slide rods whereby said fore and aft brackets are shifted along said slide rods.

9. An apparatus as claimed in claim 8, including a grinding module base plate extending between and operably pivotally coupled to said fore and aft brackets, said pivot means including means for pivoting said grinding module base plate relative to said fore and aft brackets.

10. An apparatus as claimed in claim 9, said grinding module base plate being coupled to said fore and aft brackets by a pair of opposed pivot support members, said horizontal positioning means including means for raising and lowering said grinding module base plate relative to said pivot support members.

11. A rail grinding apparatus for grinding the rails of a railroad track, said rails each having a longitudinal rail axis, comprising:

a support frame including a main frame supported by said rails for movement along said railroad track;

a plurality of grinding modules, each grinding module having a grinding head engagable with one of said rails;

vertical positioning means operably coupling one of said grinding modules to said support frame for selectively raising and lowering said one grinding module relative to said one of said rails independently of the vertical position of the other of said grinding modules;

horizontal positioning means operably coupling said one grinding module to said support frame for laterally shifting said one grinding module generally transversely to said longitudinal rail axis independently of the vertical orientation of said one grinding module and of the lateral position of the other of said grinding modules;

pivot means operably coupling said one grinding module to said support frame for pivoting said one grinding module about a pivot axis whereby the grinding head of said one grinding module is selectively pivotable and vertically and horizontally positionable independently of the vertical and horizontal orientation of said one grinding module and of the vertical, horizontal, or pivotal orientation of the other of said grinding modules; and an undercarriage depending from said main frame for carrying said grinding modules, said undercarriage including undercarriage rail engaging wheels, an undercarriage lateral shifting means for laterally shifting said undercarriage rail engaging wheels into and out of engagement with said rails, undercarriage vertical positioning means operably coupling said undercarriage to said main frame for vertically raising and lowering said undercarriage relative to said main frame, and rail detecting means adapted for operably engaging said railroad track for detecting the position of said rails as said undercarriage is lowered from said rail clearing position.

12. An apparatus as claimed in claim 11, said rail detecting means including retracting means for retracting said rail detecting means from engagement with said rails when said rail engaging wheels engage said rails.

13. A rail grinding machine for grinding the rails of a railroad track, comprising:

a support frame supported by said rails for movement along said railroad track;

a grinding module having a grinding head including a grinding stone engagable with one of said rails for grinding the rail; and means for operably coupling said grinding module to said support frame about a generally horizontal pivot axis, said support frame including a main frame supported along said rails by main frame rail engaging wheels, and an undercarriage carried by said main frame, said undercarriage shiftable between a raised rail clearing position and a lowered rail engaging position, said undercarriage including undercarriage rail engaging wheels for engaging said rail when said undercarriage is in said rail engaging position, said means for operably coupling said grinding module to said support frame comprising means for pivotably coupling said grinding module to said undercarriage, said undercarriage including fore and aft, generally upright support members and a grinding module suspension assembly extending between said fore and aft support members, said suspension assembly including a generally horizontal upper support member and opposed, fore and aft, downwardly depending support brackets, said support brackets each having an upper end operably carried by said upper support member and a lower end positionable in close proximity to said rail when said undercarriage is in said lowered, rail engaging position, said means for pivotably coupling said grinding module to said undercarriage comprising means for operably pivotably coupling said grinding module to said lower ends of said fore and aft support brackets.

14. An apparatus as claimed in claim 13, said means for operably pivotably coupling said grinding module to said lower ends of said fore and aft support brackets including means for selectively raising and lowering said grinding module relative to said undercarriage.

15. An apparatus as claimed in claim 14, said means for operably, pivotably coupling said grinding module to said lower ends of said support brackets comprising opposed pivot support elements carried by said fore and aft support brackets, each pivot support element including a lowermost end pivotably carried by its respective support bracket and an upper end including means for operably coupling said grinding module to said support element above said pivot axis.

16. An apparatus as claimed in claim 15, said support element upper end comprising a support sleeve, said means for operably coupling said grinding module to said support element comprising a support rod operably coupled to said grinding module and shiftably received within said support sleeve.

17. An apparatus as claimed in claim 16, including an extensible means operably coupling said support sleeve to said support rod for selective shifting of said grinding module relative to said support element.

18. An apparatus as claimed in claim 13, said grinding module shiftable through an arcuate path of travel between a field side pivot limit and a gauge side pivot limit, said upper support member being oriented above said arcuate path of travel and between said field side and gauge side pivot limits.

19. An apparatus as claimed in claim 18, said upper support members comprising spaced apart field side and gauge side frame member and slide rods extending between said field side frame member and said gauge side frame member, said undercarriage including means for shiftably mounting said fore and aft support brackets to said slide rods and means for shifting said brackets along said slide rods for selective shifting of said grinding module transversely across said rail.

* * * * *

UNITED STATES PATENT AND TRADEMARK OFFICE

CERTIFICATE OF CORRECTION

PATENT NO. : 4,862,647

DATED : September 5, 1989

INVENTOR(S) : Robert G. Vieau

It is certified that error appears in the above-identified patent and that said Letters Patent is hereby corrected as shown below:

Column 7, line 41, delete the word "pivot," and substitute therefor --pivot axis,--.

Column 7, line 48, delete the word "said" and substitute therefor --an--.

Signed and Sealed this

Ninth Day of July, 1991

*Attest:*

HARRY F. MANBECK, JR.

*Attesting Officer*

*Commissioner of Patents and Trademarks*